US005243897A

United States Patent [19]

Walton et al.

[11] Patent Number: 5,243,897

[45] Date of Patent: Sep. 14, 1993

[54] MAGNETICALLY ACTUATED FLUID MOTOR

[75] Inventors: Frank A. Walton, Argyle; Edward C. Grout, Corinth, both of Tex.

[73] Assignee: Frank & Robyn Walton 1990 Family Trust, Argyle, Tex.

[21] Appl. No.: 864,637

[22] Filed: Apr. 7, 1992

[51] Int. Cl.[5] ..... F01L 15/12; F01B 25/26

[52] U.S. Cl. ..... 91/224; 91/229; 91/344; 91/DIG. 4; 92/5 R; 92/181 P

[58] Field of Search ..... 91/1, 222, 224, 226, 91/227, 229, 247, 248, 344, 346, DIG. 4; 92/5 R, 181 R, 181 P

[56] References Cited

U.S. PATENT DOCUMENTS

| | | | |
|---|---|---|---|
| Re. 29,193 | 4/1977 | Carlyle | 137/99 |
| 1,506,834 | 9/1924 | Hook | 251/75 |
| 1,674,614 | 6/1928 | Berkman | 417/403 |
| 2,262,031 | 11/1941 | Meyer | 137/99 |
| 2,712,427 | 7/1955 | Welborn et al. | 251/61 |
| 2,750,930 | 6/1956 | Baur et al. | 121/164 |
| 2,987,051 | 6/1961 | Goyette et al. | 91/229 |
| 3,213,873 | 10/1965 | Cordis | 137/99 |
| 3,405,606 | 5/1972 | Scheffer | 91/306 |
| 3,665,808 | 5/1972 | Vestal | 91/272 |
| 3,680,985 | 8/1972 | Ginsberg et al. | 417/502 |
| 3,692,274 | 9/1972 | Rosen et al. | 251/75 |
| 3,753,528 | 8/1973 | Gibbs | 239/61 |
| 3,901,313 | 8/1975 | Doniguian et al. | 166/64 |
| 3,937,241 | 2/1976 | Cloup | 137/99 |
| 4,060,351 | 11/1977 | Cloup | 417/520 |
| 4,352,644 | 10/1982 | Landrum et al. | 91/227 X |
| 4,558,715 | 12/1985 | Walton et al. | 137/99 |
| 4,610,192 | 9/1986 | Hartley et al. | 91/346 X |
| 4,756,329 | 7/1988 | Cloup | 137/99 |
| 4,809,731 | 3/1989 | Walton et al. | 137/99 |
| 4,815,441 | 3/1989 | Schawbel et al. | 431/344 X |
| 5,055,008 | 10/1991 | Daniels et al. | 91/229 X |
| 5,137,435 | 8/1992 | Walton | 91/229 X |
| 5,150,643 | 9/1992 | Saita | 92/181 R X |

FOREIGN PATENT DOCUMENTS 595458 12/1947 United Kingdom .

*Primary Examiner*—Edward K. Look
*Assistant Examiner*—Hoang Nguyen
*Attorney, Agent, or Firm*—Hubbard, Thurman, Tucker & Harris

[57] ABSTRACT

A magnetically actuated fluid motor has a shiftable member having valve members for alternately closing one and opening the other of large and smaller faces of a stepped piston reciprocating in a housing. The shiftable member carries a magnet and is shiftable to collocate the magnet with one of spaced apart magnet attractors. A magnetic holding force between the magnet and attractors exceeds a simultaneous resilient counterforce supplied by spring members operating on the shiftable member. When the magnetic holding force is weakened by application of a separating force to separate the magnet from an attractor, stored energy in the compressed springs is released to shift the shiftable member. Separating force is applied through stops which arrest the shiftable member while the piston continues to move, without immediately opening the closed face of the stepped piston. Once the magnet is separated from the nearest magnetic attractor by a pre-shift amount, so that the resilient shifting force exceeds the weakened magnetic holding force, the shiftable member shifts, closing the open face and opening the closed face of the piston to reverse the piston stroke. The magnet carried by the shiftable member operates in a chamber-like area having fluid ports which dampen the shifting action.

38 Claims, 4 Drawing Sheets

MAGNETICALLY ACTUATED FLUID MOTOR

BACKGROUND OF THE INVENTION

1. Field of the Invention

The invention pertains to an improved magnetically actuated fluid motor powered by a primary fluid stream and useful for attachment to a pumping apparatus for injecting predetermined quantities of secondary fluid additive into the primary fluid stream.

2. Background of the Prior Art

It has been found that a reciprocating fluid motor can be powered by energy from a pressurized primary fluid line which is useful to drive an attached pump which injects a secondary fluid into the primary fluid stream. Such devices have been useful in applications such as adding medication to drinking water for livestock, treating water with additives such as halogens, or adding fertilizer concentrate to irrigation water. A shifter mechanism with valves carried by the piston enables the fluid pressure to be applied to either face of a stepped piston which forms the driving member for a metering piston interacting with a cylinder in communication with a storage vessel of the product to be injected. Such devices are found in my own U.S. Pat. Nos. 4,558,715 and 4,809,731, as well as U.S. Pat. No. 4,756,329 to Jean Cloup.

In conventional reciprocative fluid power motors, a sliding shaft extends through the head of a differential stepped piston, usually through the center of the piston, and extends on both sides of the piston. The shaft is connected to a toggle mechanism which controls two sets of valves to alternately close fluid passages in one stepped piston face and open a flow passage or passages in the other stepped piston face. When the piston moves up or down and responds to greater fluid pressure on one of the stepped faces, the upper or lower ends of the rods strike the housing causing the rod to stop moving while the piston continues to move. This causes relative sliding movement between the rod and the pressurized face of the piston requiring a seal therebetween to prevent the loss of pressure. It would be desirable to eliminate the need for such a seal.

The toggle mechanisms require strong springs in order to provide a sufficient "kick" to shift the rod which controls the valve members. This is necessary to ensure continued operation especially in the face of contamination over extended periods of time with aqueous solutions and contaminants. Thus, conventional designs for these pump motors have a multitude of parts which are subject to stresses, wear and corrosion which decrease the ease of assembly, disassembly and maintenance. In addition, the use of strong springs makes the conventional toggle mechanisms noisy, and the usual design makes it difficult to eliminate the noise.

It would be desirable to produce a quieter unit because pumping apparatus of this kind are frequently used in places where noise in operation may disturb people in the surrounding area. It would be desirable to have a unit with less powerful springs which in addition to reducing the noise factor, produces less wear and tear on the unit during operation. It would also be desirable to produce a unit which employs springs which operate in compression rather than tension because that makes it easier to provide secondary treatment in manufacturing which makes them less subject to breakage or corrosion and easier to install. The open coil design of a compression spring makes it possible to employ mechanical treatments and easier to reach all areas with chemical treatments. All these and more advantages are provided by the improved magnetic activated fluid motor.

SUMMARY OF THE INVENTION

An improved primary fluid-driven, magnetically actuated reciprocating motor for a pump apparatus may be connected for reciprocation of any conventional secondary fluid additive pump whereby the liquid additive may be metered in a predetermined manner for injection into a primary fluid stream.

The improved magnetically actuated fluid motor has a housing means with a primary fluid inlet and outlet and internal walls which serve as cylinders for the large face and a smaller face of a stepped piston mounted for reciprocation in the housing and separating the interior of the housing into at least first and second variable chambers. The center portion of the piston is hollow and contains a shiftable member and valve means carried with the piston, shiftable relative to the piston between a first position and a second position wherein the valve means at the first and second positions alternately close one and open the other of the piston faces to pressurized fluid. The shiftable member may be described as a spool member which extends partly within the center of the piston and partly through the large piston face into the second variable chamber defined by an interior wall and the large face of the piston. The first variable chamber is formed between a smaller diameter annular inner wall of the housing and the small diameter portion of the stepped piston.

The improved motor has spaced apart magnet attracting members mounted within the piston for movement with the piston. These may be donut-like ring members which surround the shiftable spool member. The shiftable spool member carries a magnetic means which is shiftable with the shiftable member between the magnetic attracting members alternately proximate one or the other of the magnetic attracting members in the first and second positions of the shiftable member. The magnetic means generates a magnetic holding force with the oppositely arranged magnet attracting members sufficient to hold the shiftable member in the first or second position against counterforces exerted on the shiftable member by resilient means. If the spaced apart magnet attracting members are viewed as upper and lower with respect to the housing with the upper magnet attracting member being closer to the large face, the magnetic means is located adjacent the upper magnet attracting member in the first shifted position and adjacent the lower magnet attracting member in the second shifted position. This is a stable position which holds one of the valve means open to open one of the faces of the piston to fluid flow therethrough and simultaneously closes the other of the piston faces.

A resilient means is employed to exert counterforces on the shiftable member tending to balance the opposing magnetic holding force between the magnetic means and the magnetic attracting member in either of said first or second shifted positions, said counterforce being insufficient to cause the shiftable member to shift significantly until the magnetic force is weakened by separation of the magnetic means from an adjacent magnetic attracting member. Separating means are employed to weaken the magnetic force by separating by a small distance the magnetic means from the magnetic attracting member such that the counterforce overcomes the weakened magnetic force to shift the shiftable member, thereby alternating the valve members and reversing the reciprocation of the piston.

The magnetic force is at a maximum when the magnetic means is proximate the magnetic attracting member, and at that point it is nearly balanced by the opposing counterforce provided by the resilient means. The resilient force represents stored energy which is ready to be released as soon as the magnetic force is weakened. The separating force is provided by differential pressure on the faces of the piston itself, and it is quite large. When even a small separation is initiated between the magnetic means and a magnet attracting member, the resilient means overcomes the weakened magnetic force and begins shifting the shiftable member toward the other of the first or second positions. As the gap between the magnetic means and the magnet attracting member is gradually increased, the magnetic holding force is still further weakened and the resilient means is able to complete the shift whereby the magnetic means moves from one magnet attracting member through a neutral point between the magnet attracting members and then is increasingly attracted itself to the other opposite magnet attracting member. The magnetic holding force continues to increase until the full magnetic holding force is achieved when the magnetic means is proximate the opposite magnet attracting member and the valves are shifted with the shiftable member. Thus, cooperation between the magnetic means and the resilient means produces a smooth, shifting motion in which a much weaker spring is used than is used in the conventional designs.

The shiftable spool member is preferably hollow and rides over a rod member extending from the housing down into the spool member. The resilient member comprises upper and lower springs mounted on the rod member which extends into the hollow center of the spool member. The upper end of the upper spring is in contact with the housing above the farthest travel of the piston or a stop located there and the lower spring is captured between an abutment in the spool member and the lower end portion of the rod member. With the shiftable member in the first position, the lower face of the piston is closed and the piston moves upward toward the housing compressing the upper spring. A separating means is provided by contact between the upper end of the shiftable spool member and the housing which initiates reciprocation in the opposite direction by separating the magnetic means from the upper attractor. As the spring expands, it provides a decreasing shifting force sufficient to shift the spool member so that the magnetic means goes beyond the neutral point and then the magnetic holding force is rapidly increased as the magnet approaches the other magnet attracting member.

With the spool shifted to the second position, the upper face of the piston is now closed and the smaller face open so that fluid pressure moves the piston downward and the lower spring is gradually compressed between an abutment on the end of the rod and the abutment in the spool member while the piston moves. The bottom of the stroke is reached when the lower spring is completely compressed whereupon it provides a separating means with slight continued movement of the piston in the downward direction. The coils of the spring are in contact with each other so that force is transmitted directly from the rod member to the spool member sufficiently to initiate a slight separation of the magnetic means from the lower magnet attracting member whereupon the lower spring overcomes the weakened magnetic force and shifts the shiftable member back into the first position.

BRIEF DESCRIPTION OF THE DRAWINGS

FIG. 1 is altered by rotating the valve members into the same plane so they can be seen in one view);

DETAILED DESCRIPTION OF THE PREFERRED EMBODIMENT

Figure 1:
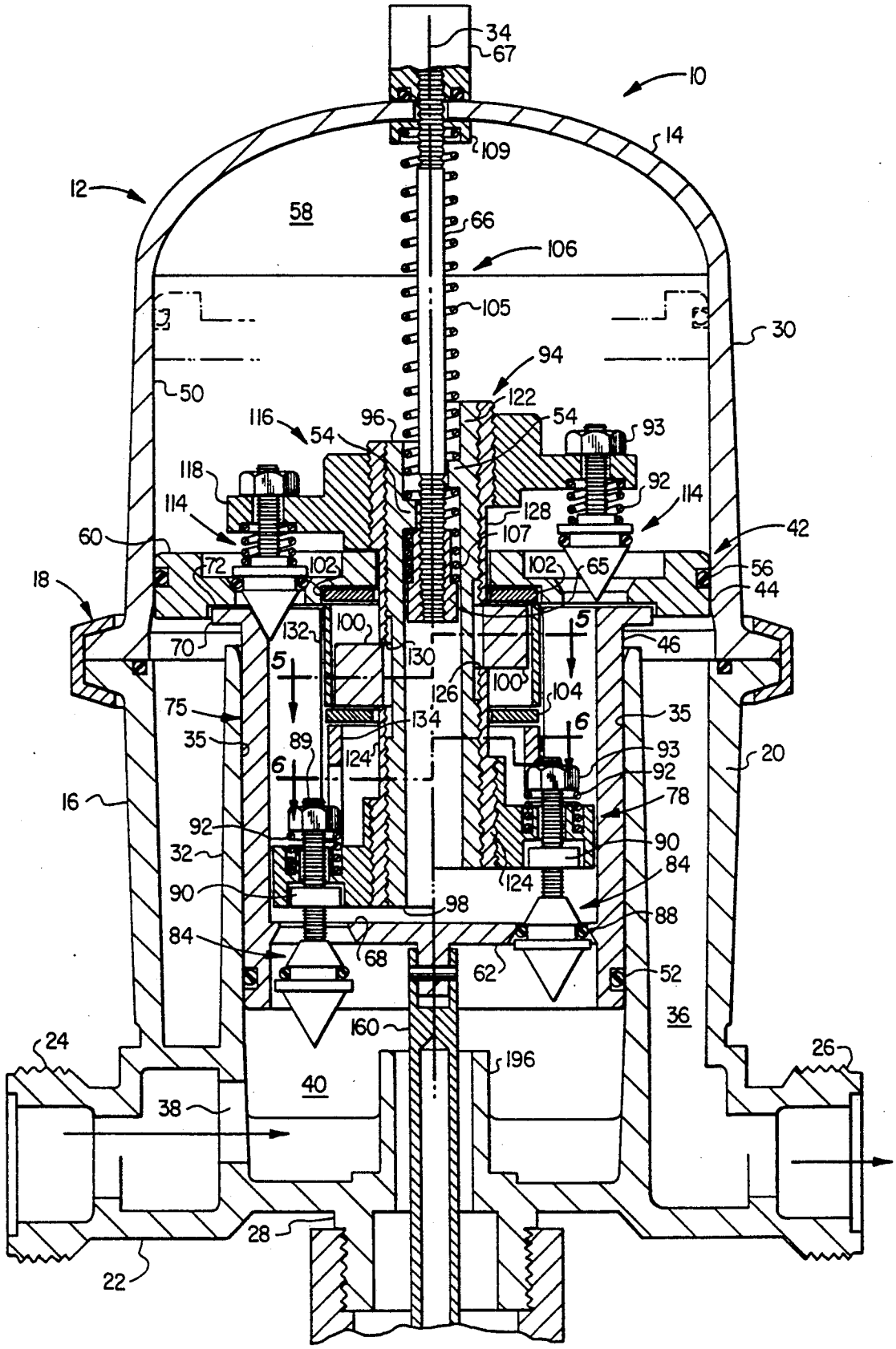
FIG. 1 is a longitudinal central section view of the magnetically actuated fluid motor invention showing a lift half as it appears in a second position with the stepped piston at the bottom of its stroke, the resilient means being fully compressed and about the apply the separating counterforce to separate the magnetic means from the lower magnetic attractor; the right half showing the position just after the shiftable member has shifted back into the first position with the piston ready to begin moving upward in response to pressure against the small face of the stepped piston

In the description which follows, like parts are marked throughout the specification and drawing with the same reference numerals, are not necessarily to scale and certain features of the invention may be shown exaggerated in scale or in somewhat schematic form in the interest of clarity and preciseness.

Referring to FIG. 1, the improved, magnetically actuated fluid motor is generally indicated by the reference numeral 10. A cylindrical housing designated generally as 12 has a domed upper portion 14 and a lower portion 16 forming a substantially cylindrical closure, closed in a leak-proof manner at a medial joint 18 which may include a seal and a clamping ring. Lower part 16 has a lower cylindrical wall 20 closed by a bottom wall 22. Connected to lower wall 16 is fluid inlet 24 and fluid outlet 26. Pressurized primary fluid enters inlet 24 and ultimately exits through outlet 26. Bottom wall 22 has a threaded boss 28 for sealed connection with an injection pump cylinder 48 shown in FIG. 2. Upper part 14 has a cylindrical wall 30. Extending from lower wall 22 is a smaller diameter axially arranged inner cylindrical wall 32 concentric with central axis 34 and the larger diameter wall 30.

Cylindrical wall 32 stands concentrically with wall 20, giving a smaller diameter, and having cylindrical bore 35. Annular space 36 defined by walls 20, 32 is in communication with an outlet passage leading to outlet 26. An opening 38 in the lower portion of wall 32 is in fluid communication with inlet 24 as part of an inlet passage leading to a first variable chamber 40. Alternately, a different mode of operation could be provided by attaching the source of primary fluid to the outlet 26 and the inlet 24 becomes the outlet. In order to prevent pressure on the closed faces of the piston from tending to open the valve members away from their seats, the valve members would seat on the opposite side of the large and small piston faces. Then pressure driving the piston could not push the valve members open because the pressure would force the valve members more tightly against their seats. The alternate arrangement would have the advantage that the flow of primary fluid would come down through the piston body so that secondary fluid entering the bottom would not pass through the pump mechanism. It would be mixed below the piston to pass with the fluid to the exit.

A stepped piston generally designated 42 having a large-diameter upper part 44 and a smaller diameter lower body part 46, is slidingly mounted for reciprocation in the housing with the smaller part sealingly engaging the bore 35 of wall 32 and the larger diameter part sealingly engaging the bore 50 of upper housing 14. Suitable "O" ring seals 52,56 are installed in peripheral grooves.

Large diameter part 44 of stepped piston 42 has an upper face 60 defining a second variable chamber 58, in upper housing 14. Similarly, smaller diameter part 46 has a face 62 which defines first variable chamber 40. The space 36 may be referred to as a third variable chamber because it also changes as the piston moves.

The stepped piston reciprocates to occupy a variety of positions which varies the chamber volumes. In a preferred mode, chamber 40 is in permanent communication with inlet 24 for the primary fluid, chamber 36 is in permanent communication with the fluid outlet 26 while the chamber 40 is in selective communication with chamber 58 through interior 64 of the piston, chamber 58 also being in selective communication with chamber 36 through upper part 44 of the piston 42 when the upper valves are open.

A rod member 66 is centered in the housing and attached to the domed upper portion 14. The upper end of the rod member preferably extends through the housing where it is sealed by keeper 67. A hollow shiftable member 94 is centered in the piston, having an upper first end 96 and a lower second end 98, the lower end 98 being contained within said piston and the upper end 96 extending out of the piston into second variable chamber 58.

The lower end portion of rod member 66 extends into the hollow center of shiftable member 94, below an abutment means 54 formed in the hollow center of the shiftable member. A keeper 65 is mounted on the lower end of rod member 66 spaced below abutment 54. Rod member 66 and shiftable member 94 cooperatively engage resilient means generally designated 106 comprising upper spring member 105 and lower spring member 107 in opposed relationship to each other. Upper spring 105 is captured on rod member 66 between abutment 54 and a contact surface 109 at the upper wall of the housing. Lower spring 107 is captured on the rod member between keeper 65 and abutment 54. Spring members 105,107 are compression springs. When one of the springs is compressed by movement of the piston, the other extends.

Surrounding the central part of shiftable member 94 is a magnetic means 100 which is shiftable with the shiftable member between spaced apart magnet attractors 102,104. Resilient means 106 exerts counterforces against the shiftable member. Upper spring member 105 exerts a downward counterforce on the shiftable member when piston 42 is moving up in FIG. 1. Lower spring member 107 exerts an upward counterforce on the spool member when piston 42 is moving down. These spring counterforces are less than the force of attraction between magnetic means 100 and magnet attractors 102,104 until the magnetic force is weakened by separation of the magnetic means from an adjacent magnet attractor by a separating means. When piston 42 is moving up in FIG. 1 a separating means is provided by contact between upper end 96 of shiftable member 94 and a contact surface 109 on the housing. When piston 42 is moving down a separating means is provided by full compression of lower spring 107 between an abutment surface on keeper 65 and abutment surface 54 in the center of the shiftable member. The separating means provide large separating forces which amount to mechanical stops that prevent further movement of the shiftable member and are completely independent from the resilient forces provided by spring members 105,107.

Figure 2:
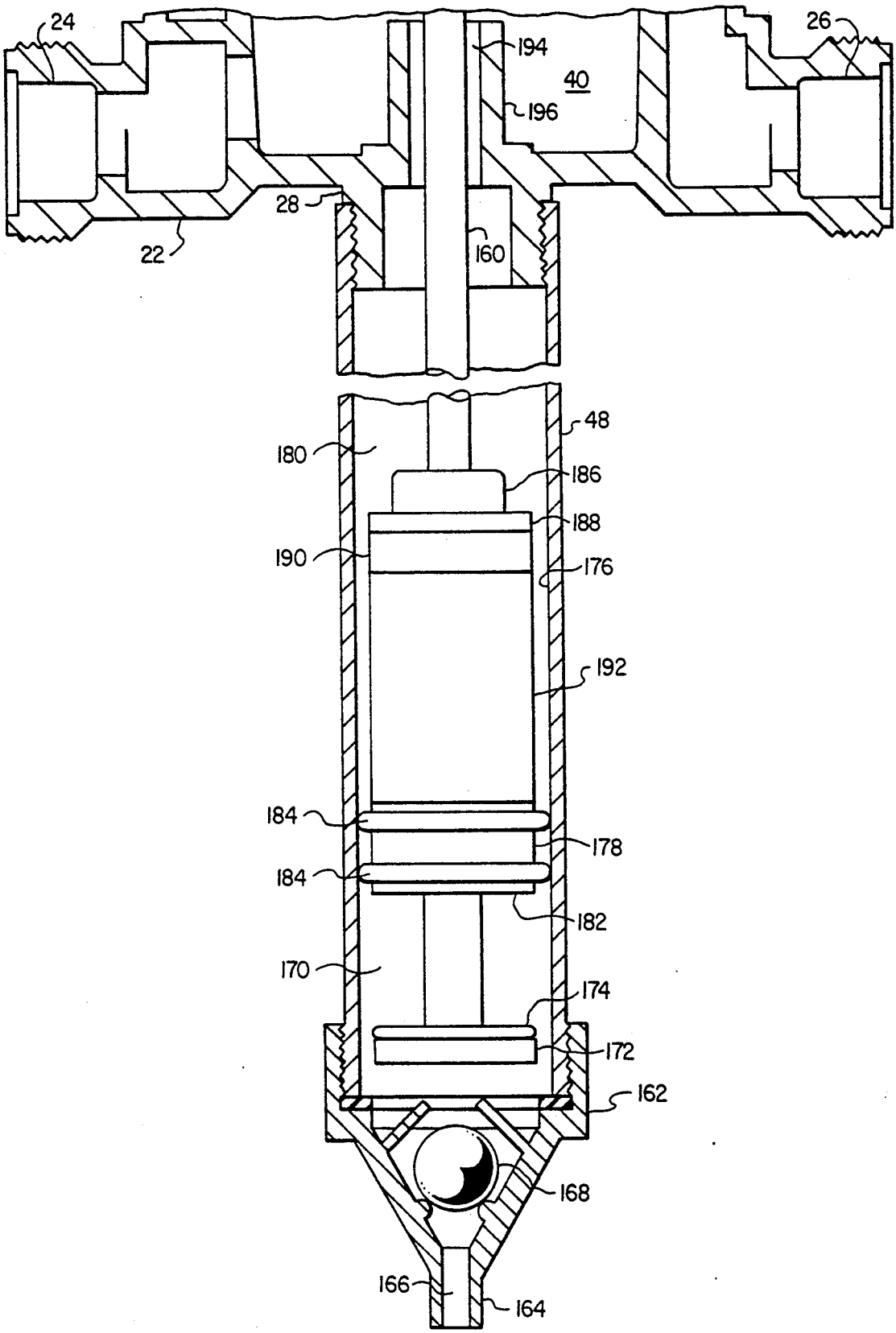
FIG. 2 is a partial cross-section view of a reciprocable pump attached to the bottom of the housing of the magnetically actuated motor of FIG. 1.
Figure 3:
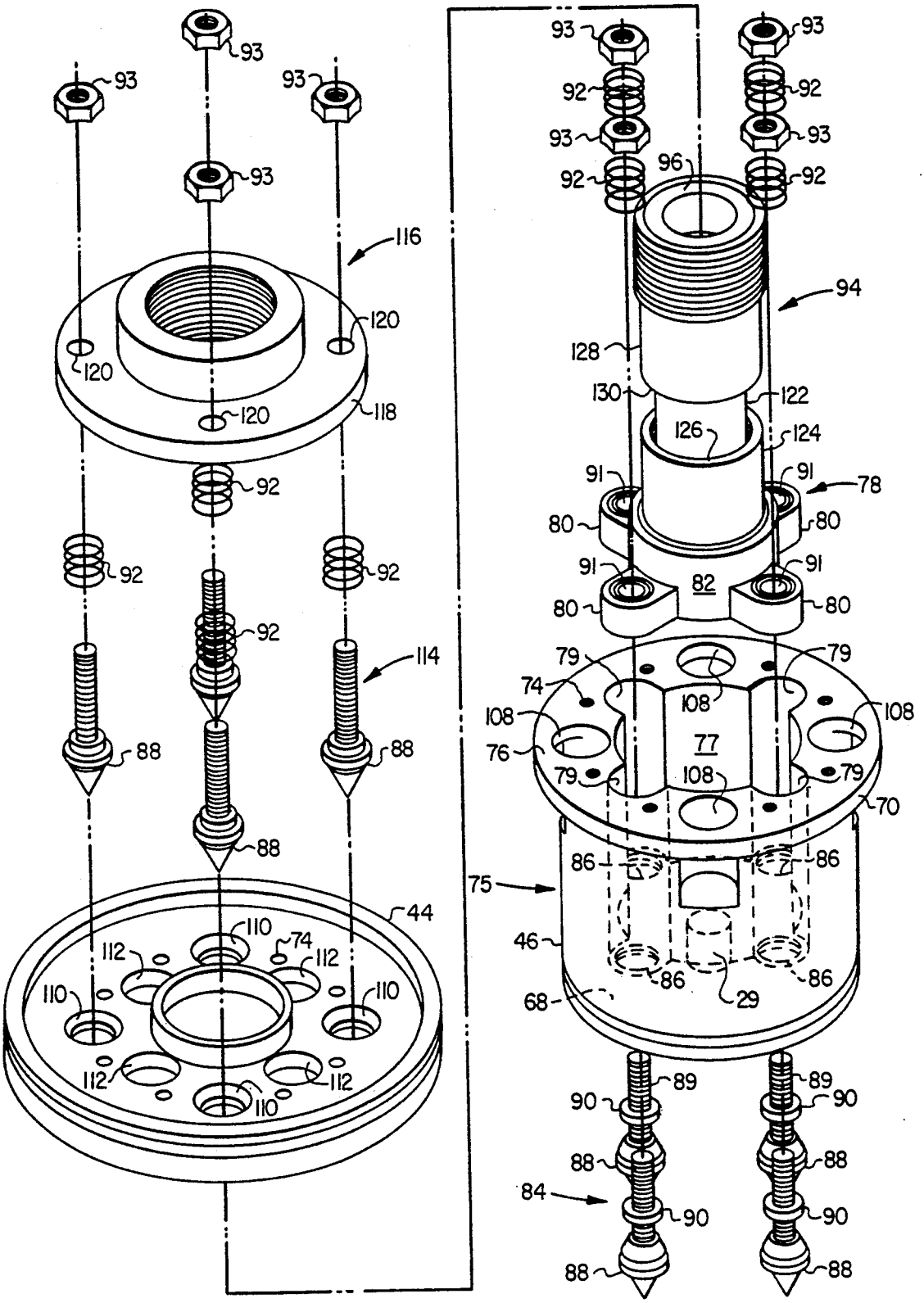
FIG. 3 is an exploded perspective view of the stepped piston, which shows the spool member and the valve holding flanges without the magnetic means and the magnetic attractors.
Figure 4:
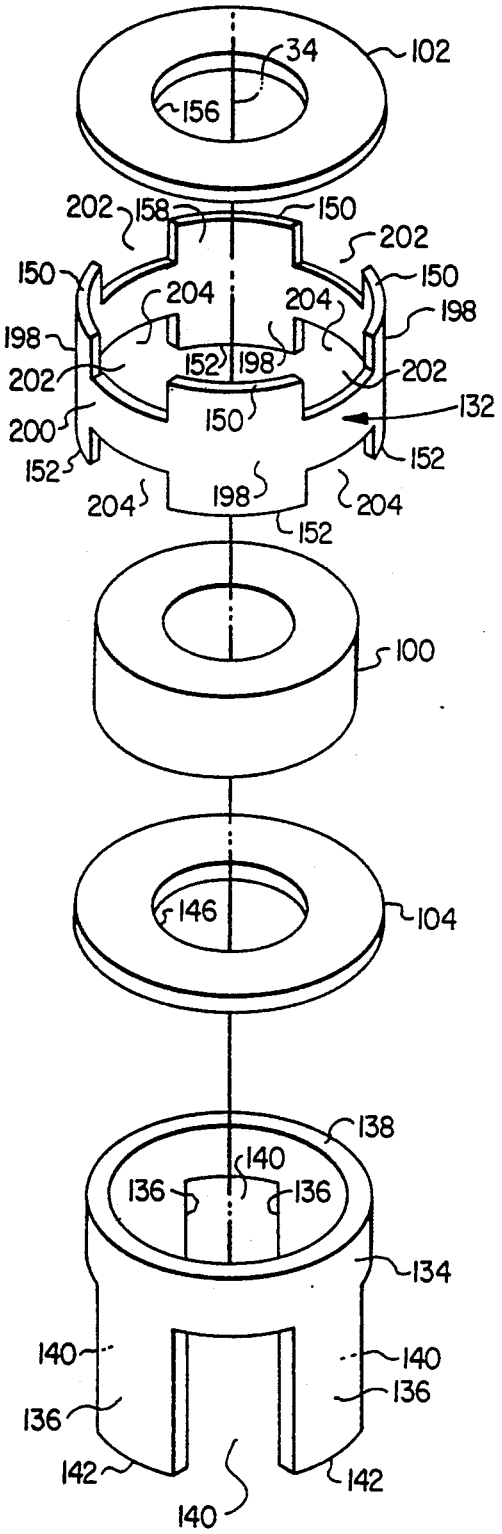
FIG. 4 is an exploded perspective view of FIG. 1 showing the magnet, the spaced magnet attractors, and the spacers which surround the spool member.
Figure 5:
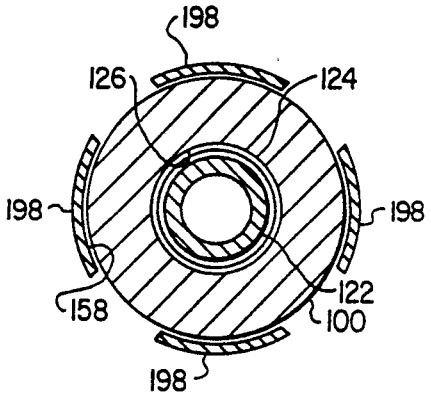
FIG. 5 is a cross-section of the magnetic means within the piston on the line 5—5 of FIG. 1.
Figure 6:
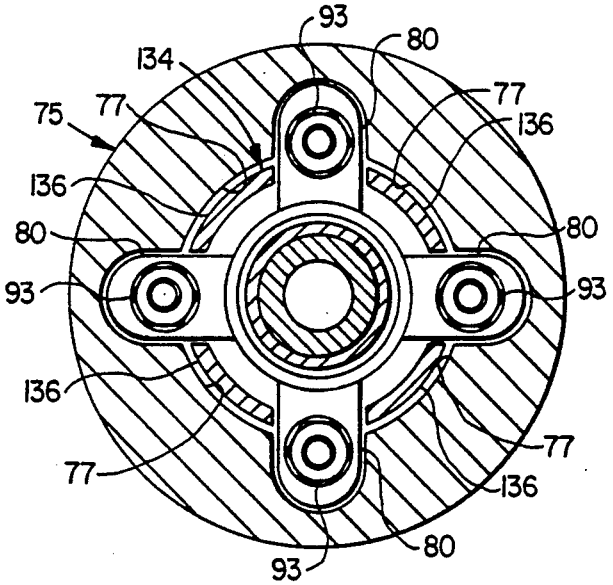
FIG. 6 is a cross-section through the entire piston along the line 6—6 of FIG. 1 showing the assembly of the spool member, pedestal, spacer and lower flange holding valve members.

FIG. 3 is an exploded perspective view of the operating components of the compression spring fluid motor 10 without the magnetic means and magnet attractors and spacers which are shown in FIGS. 4–6. The lower part of the piston is molded as a single body 75 having the smaller diameter cylindrical wall 46 connected to a base wall 68 and an upper flange 70. Extending downwardly from base wall 68 is extension 29 which drives the piston rod of the injection pump shown in FIG. 2. Flange 70 fits into a circularly shaped recessed portion 72 of large part 44, better seen in FIG. 1. A plurality of circularly arranged fastener openings 74 are used to secure the large diameter upper flange 44 to the upper flange 70 of the piston body. Together they form the large diameter piston head.

Flange 70 has an upper face 76 forming a shaped central opening for receiving a second valve means generally designated by reference numeral 78. Piston body 75 has an axially extending circular shaped central opening 77 with lobes 79 positioned at 90 degree intervals around circular shaped opening 77. Lobes 79 receive arms 80 which extend from circular body 82 of second valve means 78. Openings in bottom wall 68 of the piston body at the bottom of each lobe 79 comprise second valve seats 86 for second valve members 84. Valve members 84 have cone-shaped portions for receiving "O" ring seals 88 which seal with seats 86. Valve stems 89 have stops 90 which are recessed into the bottom of arms 80 as best seen in FIG. 1. The stems of the valves are passed through openings 91 in arms 80 until stops 90 are seated in the recess under each arm 80 as shown in FIG. 1. Spring members 92 are inserted over the stems of valve members 84 and lightly compressed by fasteners 93 attached to the valve stem.

Upper flange 70 of piston body 75 has openings 108 located on either side of lobes 79 at 90 degree intervals from each other. They are separated by the wall of the piston body from circular opening 77 and lead to the outside of lower part 46, opening into third variable chamber 36. Large diameter part 44 has an equal number of corresponding openings 110 which comprise first valve seats. When circular recess 72 of part 44 is placed on upper flange 70, openings 110 are aligned with openings 108 and provide for fluid communication between second chamber 58 and third chamber 36. Large diameter part 44 also has four openings 112 aligned with lobes 79 so that when second valve members 84 are open, fluid from chamber 40 may pass into interior 64,77 of the piston and provide a passageway for fluid to reach second variable chamber 58 through openings 112. First valve means 116 includes valve collar 118 and first valve members 114 having cone-shaped portions for receiving "O" ring seals 88 and stem portions which receive springs 92. Valve collar 118 has openings 120 through which the stems of first valve members 114 are placed and secured with fasteners 93, lightly compressing the springs in assembly as indicated in FIG. 1. Valve collar 118 is threaded onto the upper end of shiftable member 94. It should be noted that in FIG. 1 first (upper) valve means 116 has been rotated 90 degrees with respect to second (lower) valve means 78 for convenience in illustration. In reality, as can be seen from FIG. 3, a section through two opposite upper valve members would not also run through two opposite lower valve members since they are rotated 90 degrees with respect to each other.

In FIG. 3, shiftable member 94 may be seen to comprise a centrally located spool 122 which extends between upper and lower ends 96,98. On the lower end portion of spool 122 is threaded collar member 124 which forms a boss 126. Similarly, the upper end portion of spool 122 has a threaded collar member 128 which forms a boss 130 spaced above boss 126. Best seen in FIG. 1, magnetic means 100, preferably a donut-shaped permanent magnet, is secured between circular bosses 126,130 of collars 124,128. Surrounding magnet 100 is a cutaway cylindrical spacer 132 which extends between and supports upper and lower magnet attractors 102,104 which are in turn supported by circular pedestal 134. This assembly is illustrated best in FIGS. 4–6.

FIG. 4 shows circular pedestal 134 which has axially aligned legs 136 and an upper surface 138. Legs 136 are at 90 degrees to each other and are separated by slots 140. At the bottom of legs 136 are feet 142 which rest on base wall 68 of piston 75. The slots are adapted to fit over arms 80 as indicated in FIG. 6. Slots 140 are deep enough so that arms 80 of second valve means 78 can shift without interference. Pedestal 134 loosely fits within cylindrical opening 77 of piston 75. Upper surface 138 supports lower magnet attractor 104 having opening 146 larger than the outside diameter of lower collar member 124 as indicated in FIG. 1. Spacer 132 has four 90 degree spaced legs 198 connected by a cylindrical band 200, the legs 198 being curved segments of a cylinder. At about 90 degree intervals around the circumference of spacer 132 are flow passages 202 above the band the flow passages 204 below the band. Legs 198 have lower terminal surfaces 152 and upper terminal surfaces 150.

Spacer 132 is assembled surrounding magnet 100 as shown in FIG. 5 with a space between the outermost peripheral edge of donut-shaped magnet 100 and inner wall 158 of the spacer. Lower surfaces 152 of spacer legs 198 rest on the outer peripheral edge of lower magnet attractor 104. Upper surfaces 150 rest against the outer bottom peripheral edge of upper magnet attractor 102. The elements in FIG. 4 are stacked on the central axis and compressed in assembly between a circular recess in the underside of large part 44 and wall 68 on the bottom of piston 75. This, together with cylindrical shaped opening 77 holds them in place.

Magnet 100, moves with spool 122 to a position adjacent one or the other of attractors 102,104. This relationship is perhaps best seen in FIG. 5. In FIG. 5, part of the upper edge of lower collar member 124 is seen and part of it is underneath magnet 100 and supporting it. This is the abutment edge 126. Upper and lower surfaces of magnet 100 are caught between abutment surfaces 126 of lower spool 124 and abutment surface 130 of upper spool 128 which securely hold it in position for shifting with spool member 122 as best seen in FIG. 1.

Because the unoccupied space inside the piston is always filled with fluid, the passageways 202,204 serve as relief ports which allow liquid to move when the magnet shifts within the spacer so that shifting is not prevented because of fluid trapped in the space between the magnet and magnet attractors. This feature permits a dampening effect on the shifting parts. By careful selection of the number and size of the flow passages in spacer 132, the shifting parts can be damped to varying degrees so that excessive shock is eliminated, especially at the end of each shift of the spool member so that smooth quiet working is obtained.

Referring now to FIG. 2, a secondary fluid injection pump is shown as disclosed in my U.S. Pat. No. 4,558,715, the description of which is incorporated by reference herein. Briefly, an injection pump cylinder 48 is attached to the bottom of housing 16 at threaded boss 28. Cylinder 48 is closed at its lower end by removable cap 162. Cap 162 includes fitting 164 forming a liquid additive inlet passage 166. Check valve 168 prevents flow of fluid out of the interior chamber 170 through passage 166. Lower transverse flange 172 at the end of piston rod 160 supports circumferential seal 174. Pump cylinder 48 has an internal bore 176 slidingly supporting piston 178. Piston 178 is slidably journaled on rod 160 and includes a plurality of longitudinal passages formed therein communicating with chamber 170 below the piston and with chamber 180 above the piston assembly in the upper part of cylinder 48. Face 182 of piston 178 is engageable with seal ring 174 to close off fluid communication between chambers 170 and 180. Piston 178 has suitable seals 184. Rod 160 may be dividable into an upper and lower rod removably connected with collar 186. Stacked above piston 178 are a plurality of additive pump displacement control washers 188,190 and 192 which are of smaller diameter than bore 176 and are loosely retained on piston rod 160 to permit free flow of additive fluid therearound.

When piston 178 moves down, fluid is forced through the longitudinal passages between chamber 170 to chamber 180. When the piston rod is moved upward, flange 172 moves upwardly to sealingly engage the piston 178 with seal 174. Further upward movement draws additional additive fluid into lower chamber 170 while causing fluid above the seals 184 to enter the housing containing the primary fluid through opening 194 in wall 196 of the housing in a predetermined quantity, depending upon the number of washers and the pump stroke cycle which is determined by reciprocation of the motor in the housing above.

Operation of the magnetic actuated motor will now be described with the piston moving downwardly in the position of the left-hand side of FIG. 1. In the left-hand side of FIG. 1, pressurized fluid is flowing into inlet 24 through opening 38 into chamber 40. Shiftable member 94 has previously been shifted into the second, or downward, position, with magnetic means 100 adjacent lower attractor 104. Second valve means 78 fixed to collar 124 at the lower end of spool 122 has fully opened second valve members 84. Consequently, pressurized fluid is free to flow into the interior 64,77 of piston body 75 through openings 112 into second variable chamber 58. Greater pressure on upper face 60 of the piston is driving the piston downwardly in FIG. 1. First valve means 116 carries first valve members 114 which are seated in openings 110. Fluid in third variable chamber 36 is forced to exit through outlet 26. Lower spring 107 has become fully compressed between keeper 65 and abutment 54 with the coils just about to touch. Energy is stored in spring 107, but the counterforce provided by the spring is less than the magnetic force of attraction between magnet 100 and magnet attractor 104. The piston is still pressured to move downward.

Since rod member 66 is fixed to the housing, shiftable member 94 can no longer continue to move with the piston and a large separating force is applied by virtue of the fully compressed spring 107 which applies a separating force which begins to separate magnet 100 from attractor 104 because magnet 100 is now held stationary while the piston continues to move downward. As a slight gap develops between magnet 100 and attractor 104, the magnetic attractive force is rapidly weakened. First valve members 114 remain closed in spite of a slight relative continued downward movement of the piston relative to the now stopped shiftable member because of springs 92 which were slightly compressed as a result of the previous shift.

Now that the magnetic force is weakened by a small gap between magnet 100 and attractor 104, the counterforce provided by spring 107 now exceeds the weakened magnetic force and drives shiftable member 94 upwardly relative to stepped piston 42, further weakening the magnetic force of attraction between magnet 100 and attractor 104. When magnet 100 reaches the midpoint between attractors 104 and 102, the effective magnetic force becomes neutral since the magnet 100 is equidistant between the attractors. The counterforce provided by spring 107 is decreasing as spring 107 expands, but as magnet 100 begins to approach attractor 102, the magnetic force of attraction between magnet 100 and attractor 102 rapidly increases as magnet 100 approaches upper attractor 102 further driving the shifter upward relative to the piston. Simultaneous with the weakening of the magnetic force to the point where the counterforce provided by spring 107 exceeds it, valve members 114 are cracked open and the piston stops moving downward. As magnetic means 100 moves adjacent to attractor 102, second valve members 84 are seated in openings 86, closing the smaller face of the piston and valve members 114 are fully open as illustrated on the right half of FIG. 1.

The shiftable member has now been shifted into the first position. Since the smaller face of the piston has now been closed by second valve members 84, pressure on the smaller face in second variable chamber 40 drives the piston upward in FIG. 1. Fluid contained in second variable chamber 58 is free to flow through valve seats 110, openings 108 in piston 75 and into third variable chamber 36 thence to outlet 26. As the piston moves upward, spring member 105 is gradually compressed between abutment 54 in the spool member and contact surface 109, but the counterforce produced by spring 105 never exceeds the force of attraction between magnet 100 and upper attractor 102. The shiftable member and the piston move as a single unit in the position of the right-hand half of FIG. 1.

In approximately the position of the dotted line outlining the piston in FIG. 1, spring member 105 has been compressed and end 96 of shiftable member 94 comes in contact with contact surface 109 which stops any further upward movement of spool member 122 of shiftable member 94. As the piston continues to move upward, a separating force is generated. The separating force begins to separate magnet 100 from attractor 102, but valve members 84 remain in sealed contact with seats 86 in response to biasing influence from springs 92 and some clearance between keepers 90 and the recess on the underside of arms 80 in which they fit. As soon as a slight gap develops between magnet 100 and attracter 102, the magnetic force between them is weakened and the resilient counterforce provided by spring 105 is now sufficient to overcome the weakened magnetic force, driving the shiftable spool member downwardly with respect to the piston. Approximately simultaneously with the overcoming of the weakened magnetic force, valve members 84 are cracked open and the upward movement of piston 42 ceases while the shiftable member continues its downward travel relative to the piston. The magnetic means goes through its neutral point between the attractors and then as spring 105 extends, magnet 100 approaches attractor 104 and accelerates the shifting process simultaneous with the weakening of the counterforce produced by spring 105. This produces a smooth action since the magnetic forces of attraction and the counterforces in opposition complement each other during the shifting process. Now since the shifter has been shifted to the second position shown in the left-hand side of FIG. 1, the first valve members are again closed and the second valve members are open so that fluid communication is again established between first variable chamber 40 and second variable chamber 58. The greater pressure on the larger diameter face 60 drives the piston downward to continue the reciprocation of the piston. The reciprocating piston drives a piston rod 160 which operates the injection pump shown in FIG. 2 to inject a secondary fluid into the primary fluid stream.

Magnet 100 shifts between upper and lower attractors 102,104 and is surrounded by spacer 132. This forms a kind of chamber in which the magnet moves, a chamber which is always filled with liquid. Openings 202,204 are preferably made in the walls of spacer 132 so that liquid within this chamber can escape when the shifter moves from one side to the other. The number and size of these openings contribute a dampening effect which can be adjusted to minimize shock produced during the shift and contribute to a very quiet operation with a minimum of wear and tear on the moveable parts. Biasing springs 92 contribute to this effect when the valve members 84,114 make contact with the seats since they are not rigidly attached to their supporting members and give slightly as the spring members 92 are slightly compressed at the end of the stroke cycle.

The need for powerful springs used in conventional designs to be wound up by movement of the piston in order to accumulate sufficient energy to "kick" open the closed valve members in one face of the piston and simultaneously close the other face is obviated in the design of the present invention. The "kick" shift usually employed is necessary because valves in the closed face of the piston are under pressure of the fluid driving the piston, which tends to hold them closed. The present invention employs what amounts to mechanical stops which provide the separating force which pre-shifts the spool member a small distance while the closed valve members remain closed. The valve member support arms 80 and collar 118, which are fixed to and move with the spool member, can move the same pre-shift amount before the closed valve members 84 or 114 are forcedly cracked open to allow pressure in the first and second variable chambers to momentarily equalize. For example, collar 118 moves upward a pre-shift amount and then encounters fastener 93 which is on the end of the valve stem of valve members 114. Since the small amount of slack provided by biasing springs 92 is now gone, further movement of collar 118 must open valves 114. Spring 107 fully compressed against keeper 65 supported by fixed rod 66 provides a direct mechanical link through to the stems of the valve members. A similar effect is achieved for second valve members 84 by means of adjustable collars 90 and springs 92. The spool member and arms 80 can move a pre-shift amount while the valves remain closed until collars 90 bottom against the underside of arms 80 whereupon the valve members must move with the further shifting of the spool member.

Simultaneously with the pre-shift movement, the spring 105 or 107, whichever is compressed to shift the spool member, overcomes the weakened magnetic force to initiate and complete shifting of the spool member. Since the valve members are now open on both sides of the closed face of the piston, the piston stops for an instant and is ready to reverse direction as soon as the shift is complete.

Springs 105 and 107 only have to overcome the weakened magnetic force at the end of the pre-shift movement. They do not have to force open closed valves which are in a pressurized chamber 40 or 58 because this is accomplished, as has been explained, by the power of the moving piston and the direct mechanical linkage. This permits much weaker springs 105,107 than the conventional design with consequent reduction in shock and wear on the internal parts and with a much smoother shifting operation. Springs 105,107 need to have an extension length sufficient to move the magnet beyond the mid-point of its travel and complete the shift. They need not be equal in length, although the effective shifting force provided must be the same at the extreme ends of the piston stroke, i.e., less than the magnetic holding force but more than the weakened magnetic force. Springs 92 need only be sufficient to hold the valve members in their seats while the piston travels and while pre-shifting occurs.

The required strength of the magnet may require some experimentation depending upon frictional losses in the shifting members and the working pressure of the primary fluid. Generally, a stronger magnet and commensurately stronger springs would work better at higher pressure and flow rates of the working fluid. A ceramic type magnet may be desirable mainly because it is less subject to corrosion and buildup of foreign deposits.

Although the shifting device in the preferred embodiment has the magnet in the middle between spaced apart magnetic attractors which could be ferrous ring members, it is within the invention if these are reversed. The magnet 100 could be ferrous material to serve as an attractor and the magnetic attractors 102,104 could be the magnets. All that is required is that they provide a magnetic holding force which is weakened by the pre-shifting of the spool member as described above.

I claim:

1. A magnetically actuated fluid motor for installation in a primary fluid line for reciprocating a fluid injection pump in response to primary fluid pressure during primary fluid flow, in operative combination comprising:

housing means having primary fluid inlet and outlet;

stepped piston means having a large face and a smaller face, mounted for reciprocation in said housing and separating the interior of the housing into at least first and second variable chambers;

spaced apart magnet attracting members mounted within the piston for movement therewith;

shiftable member and valve means carried with the piston, shiftable relative to the piston between a first position and a second position wherein said valve means at said first and second positions alternately close one and open the other of said piston faces to pressurized fluid;

magnetic means carried with said shiftable member between said magnet attracting members, being alternatively proximate one of said magnet attracting members in said first and second position of the shiftable member, said magnetic means generating a magnetic holding force sufficient to hold the shiftable member in said first or second position against counterforces exerted on the shiftable member by resilient means;

said resilient means exerting counterforces on the shiftable member tending to move the magnetic means away from the magnet attracting member at each of said first and second positions of the shiftable member, said counterforce being insufficient to cause the shiftable member to shift significantly until said magnetic force is weakened by separation of the magnetic means from a magnet attracting member; and separating means sufficient to weaken said magnetic force by separating the magnetic means from a magnet attracting member, such that said counterforce overcomes the weakened magnetic force to shift the shiftable member thereby alternating the valve members and reversing the reciprocation of the piston.

2. The magnetically actuated fluid motor of claim 1 wherein said shiftable member is an elongated spool member having an end portion extending through one of the piston faces and an opposite end portion within the piston, said spool member carrying said valve means.

3. The magnetically actuated fluid motor of claim 2 wherein said spool member receives at least an end portion of a rod member in a hollow center opening in the spool member, said rod member being attached to the housing and serving as a support for the resilient means.

4. The magnetically actuated fluid motor of claim 3 wherein said magnetic means is fixed around the outside of the spool member for shifting with the spool between said magnet attracting members, the magnet attracting members being mounted within the interior of the piston for movement therewith.

5. The magnetically actuated fluid member of claim 4 wherein at least part of said resilient means are captured between the rod member and the hollow center of the spool member for compression caused by reciprocating movement of the piston with respect to the rod member.

6. The magnetically actuated fluid motor of claim 5 wherein said resilient means comprise upper and lower springs having opposite ends, one opposite end of each spring being supported against a spool abutment located within said hollow center of the spool member.

7. The magnetically actuated fluid member of claim 6 wherein said lower spring is compressible between said spool abutment and an abutment at the lower end of said rod member.

8. The magnetically actuated fluid motor of claim 7 wherein said upper spring is compressible between a spool abutment and a stop positioned above the spool member along the rod.

9. The combination of claim 8 further including an injection pump means operated by the magnetically actuated fluid motor for injecting a secondary fluid into the primary fluid stream.

10. The magnetically actuated fluid motor of claim 6 wherein said spool member extends through the large face of the piston and being farthest extended in said first position wherein said large face is open and said smaller face is closed and less farther extended at said second position wherein said smaller face is open and said large face of the piston is closed by action of said valve means carried by the spool member.

11. The magnetically activated fluid motor of claim 10 wherein said separating means comprises an abutment surface on the spool member and a contact surface on the housing which stop the spool member while the piston is moving, causing separation of the magnetic means to shift the spool member from first to second position, thus reversing piston reciprocation.

12. The magnetically actuated fluid motor of claim 11 wherein said separating means comprises said lower spring being compressible between said spool abutment and the lower end of the rod member to generate said counterforce, and when fully compressed, stops the spool member while the piston is moving, causing separation of the magnetic means to shift the spool member from the second to the first position, thus reversing reciprocation.

13. The magnetically activated fluid motor of claim 8 wherein said separating means comprises alternate shifting of the spool member and valve means by contact with the housing and the spool member in one position, and by full compression of the lower spring in the opposite position.

14. The magnetically activated fluid motor of claim 4 wherein said magnetic means is an annular collar mounted on the spool member within a central opening of the piston.

15. The magnetically activated fluid motor of claim 14 wherein said magnetic attracting members are annular rings spaced above and below the magnetic means and supported in the piston by one or more spacers in said central opening.

16. The magnetically actuated fluid motor of claim 15 wherein said shifter means and valve means comprise said spool member having a first end and an opposite second end having respective first and second flanges for holding respective first and second valve members, said first valve member cooperating with corresponding valve seats in the large face of the piston and said second valve member cooperating with corresponding valve seats in the smaller face of the piston, the valve members being operable to open the large face and close the small face in a first shifted position of the spool member and to close the large face and open the smaller face in a second shifted position of the spool member.

17. The magnetically actuated fluid motor of claim 16 wherein initiation of shifting of the spool member from the first to the second position is caused by contact between the spool member and the wall of the housing with the piston moving in one direction and shifting is initiated from the second to the first position with the piston moving in the opposite direction by engagement between an abutment surface on the spool member and a stop on the rod member attached to the housing.

18. The combination of claim 17 further including an injection pump means operated by the magnetically actuated fluid motor for injecting a secondary fluid into the primary fluid stream.

19. A magnetically actuated fluid motor for installation in a primary fluid line for reciprocating a fluid injection pump in response to primary fluid pressure during primary fluid flow, in operative combination comprising:

housing means having primary fluid inlet and outlet;

stepped piston means having a large face and a smaller face, mounted for reciprocation in said housing and separating the interior of the housing into at least first and second variable chambers;

shifter means and valve means carried by the piston, said shifter means being shiftable for establishing a stroke cycle of said piston by alternately moving said valve means, to close one face of the piston and at the same time open the other of said piston faces to pressurized primary fluid;

magnet means mounted for movement with the shifter means between opposed magnetic attractors for generating a magnetic holding force which varies between a maximum when the magnet means is positioned adjacent one attractor, a mimimum when the magnetic means is at a neutral position between the attractors and a maximum when the magnetic means is positioned adjacent the other attractor, the maximum magnetic holding force being sufficient to hold the shifter in a shifted position in opposition to resilient shifting force generated by resilient means, the maximum magnetic holding force being weakened by separation from an adjacent one of said attractors a separating distance;

resilient means operating on said shifter to generate resilient shifting force in opposition to the magnetic holding force, said resilient force being sufficient to overcome the magnetic holding force as soon as the magnet means has been separated said separating distance from an opposed attractor, but less than sufficient to separate them when the magnetic holding force is at a maximum; and means for separating said magnet means a separating distance from either one of the opposed attractors to weaken the magnetic holding force whereupon the resilient shifting force provided by the resilient means overcomes said weakened force thereby causing the shifter means to shift, reestablishing the magnetic holding force and causing said valve means to simultaneously close one face of said piston and open the other of said piston faces to pressurized primary fluid, to cause reciprocation of the piston.

20. The magnetically actuated fluid motor of claim 19 wherein:

the valve means are biased for limited relative movement with respect to the shifter means an amount sufficient to keep the closed face of the piston closed until the magnet means is separated said separating distance from an adjacent attractor by the means for separating so that the magnetic holding force is weakened to less than the force provided by the resilient means whereupon further shifting movement exceeds the limited relative movement of the closed valve means and opens the closed face of the piston in preparation for reciprocation in an opposite direction when shifting is complete.

21. The magnetically actuated fluid motor of claim 20 wherein:

said valve means comprise at least one first valve member cooperating with at least one corresponding first valve seat in the large face of the piston and at least one second valve member cooperating with at least one second valve seat in the smaller face of the piston to alternately open one face of the piston and close the other face of the piston, said first and second valve members include a biasing member which operates to keep the at least one first or second closed valve member in contact with its at least one seat until the magnet means is separated said separating distance, whereupon shifting occurs.

22. The magnetically actuated fluid motor of claim 21 wherein:

said at least one first and at least one second valve members are supported by arms connected to the shifter means and moveable therewith, and said biasing members comprise springs which bias the valve members with respect to the arms and allow the valve members to move at least said separating distance relative to said arms.

23. The magnetically actuated fluid motor of claim 22 wherein:

said shifter means comprise an elongated spool member passing through one of said piston faces in an unsealed condition with respect to the piston and having upper and lower collars which hold the arms supporting said at least first and second valve members.

24. The magnetically actuated fluid motor of claim 23 wherein:

the magnet means is an annular collar mounted on the elongated spool member within a central opening of the piston and shiftable between upper and lower magnetic attractors, the attractors being mounted in the piston for movement with the piston, said magnetic holding force being at a maximum to resist upward shifting force when the magnet means is adjacent the lower attractor and being at a maximum to resist downward shifting force when the magnet means is adjacent the upper attractor.

25. The magnetically actuated fluid motor of claim 24 wherein:

the weakened magnetic holding force reduces the resilient shifting force during shifting of the spool member until the magnet means reaches the neutral position between the attractors and then upon further shifting of the spool member, increases the resilient shifting force until the magnetic holding force reaches the maximum at the opposite attractor.

26. The magnetically actuated fluid motor of claim 25 wherein:

the upper and lower magnetic attracting members are annular rings spaced apart above and below the magnet means and supported in the piston by one or more spacers in a central opening of the piston, the spacers including fluid passages which serve as damping ports.

27. The magnetically actuated fluid motor of claim 26 wherein:

the housing includes a centrally located depending rod member which extends into the spool member and supports said resilient means, wherein initiation of shifting of the spool member is caused by contact between the spool member and a wall of the housing with the piston moving in one direction and shifting is initiated with the piston moving in the opposite direction by engagement between an abutment surface inside the spool member and a stop located on the rod member which is attached to the housing.

28. The combination of claim 27 further including an injection pump reciprocally operated by the magnetically actuated fluid motor for injecting a secondary fluid into the primary fluid stream.

29. A magnetically actuated fluid motor for installation in a primary fluid line for reciprocating a fluid injection pump in response to primary fluid pressure during primary fluid flow, in operative combination comprising:

housing means having primary fluid inlet and outlet;

stepped piston means having a large face and a small face, mounted for reciprocation in said housing within cylinder walls contained in said housing;

a shiftable member carrying valve means comprising at least one upper spring loaded valve member for opening and closing the large face of the piston and at least one lower spring loaded valve member for opening and closing said small piston face, the shiftable member being shiftable with respect to the piston between a first position in which the upper face is open and the lower face is closed and a second position in which the lower face is open and the upper face is closed, said shiftable member being pre-shiftable relative to the piston, a pre-shift amount while the piston face being closed by one of said valve members remains closed in response to spring loaded movement of one of said at least one valve members;

magnet means and spaced apart upper and lower magnetic attractors carried with the piston, the magnet means being operable by the shiftable member to collocate the magnet means and one of said magnet attractors in a shifted position of the shiftable member to create a magnetic holding force sufficient to retain the shiftable member in a first or second shifted position during movement of the piston;

resilient means for providing a shifting force on the shiftable member in opposition to the magnetic holding force in both the first and second shifted position of the shiftable member, the shifting force being sufficient to initiate shifting of the shiftable member after the holding force is weakened by separating the shiftable member said pre-shift amount in response to a separating force; and separating means operable to provide separating force in response to movement of the piston, sufficient to move the shiftable member relative to the piston a pre-shift amount whereby the resilient means overcomes the weakened magnetic holding force and shifts the shiftable member to a first or second shifted position, establishing the end of the stroke and causing reciprocation of the piston.

30. The combination of claim 29 wherein:

pre-shifting of the shiftable member is initiated at one end of the piston stroke by contact of the shiftable member with a wall of the housing.

31. The combination of claim 30 wherein:

pre-shifting at the other end of the piston stroke is initiated by a fixed stop supported by the housing which arrests the shiftable member while the piston continues to move said pre-shift amount, during which pre-shifting movement said at least one valve member moves with the piston relative to the shiftable member, keeping the closed face of the piston closed until pre-shifting is complete.

32. The combination of claim 31 wherein:

said shiftable member comprises an elongated spool member passing through one of said piston faces in an unsealed condition with respect to the piston and having collars respectively supporting said at least one upper and at least one lower spring loaded valve member.

33. The combination of claim 32 wherein:

said magnet means is an annular collar mounted on the elongated spool member within a central opening of the piston and said magnetic attractors are annular ring members spaced above and below the magnet means and supported by the piston in combination with a spacer having fluid ports which act as a dampening means to dampen the shifting action.

34. The combination of claim 32 wherein:

the magnet means cooperates with the resilient means after pre-shifting is complete to initially reduce the shifting force because of continued attraction to the immediately previously collocated attractor until the magnet means is equidistant between the magnetic attractors and then increase the shifting force by further movement toward another magnetic attractor during shifting.

35. The combination of claim 34 wherein:

a rod member attached to the housing has an end portion extending at least partially into a hollow center opening in the spool member, and serving as a support for the resilient means.

36. The combination of claim 35 wherein:

said resilient means comprise upper and lower springs having opposite ends, one opposite end of each spring being supported by a spool abutment located within the hollow center of the spool member.

37. The combination of claim 29 further including an injection pump means operated by the magnetically actuated fluid motor for injecting a secondary fluid into the primary fluid stream.

38. A magnetically actuated fluid motor for installation in a primary fluid line for reciprocating a fluid injection pump in response to primary fluid pressure during primary fluid flow, in operative combination comprising:

housing means having primary fluid inlet and outlet;

stepped piston means having a large face and a small face, mounted for reciprocation in said housing within cylinder walls contained in said housing;

a shiftable member carrying valve means comprising at least one upper spring loaded valve member for opening and closing the large face of the piston, and at least one lower spring loaded valve member for opening and closing the small piston face, the shiftable member being shiftable with respect to the piston between a first position in which the upper face is open and the lower face is closed and a second position in which the lower face is open and the upper face is closed, said shiftable member being pre-shiftable relative to the piston, a pre-shift amount, while the piston face being closed by one of said valve members remains closed in response to spring loaded movement of one of said at least one valve members;

magnetic attractor means and spaced apart upper and lower magnet means carried with the piston, the magnetic attractor being operable by the shiftable member to collocate the magnet attractor and one of said magnet means in a shifted position of the shiftable member to create a magnetic holding force sufficient to retain the shiftable member in a first or second shifted position during movement of the piston;

resilient means for providing a shifting force on the shiftable member in opposition to the magnetic holding force in both the first and second shifted position of the shiftable member, the shifting force being sufficient to initiate shifting of the shiftable member after the holding force is weakened by separating the shiftable member said pre-shift amount in response to a separator; and separating means operable to provide separating force in response to movement of the piston, sufficient to move the shiftable member relative to the piston a pre-shift amount whereby the resilient means overcomes the weakened magnetic holding force and shifts the shiftable member to a first or second shifted position establishing the end of the stroke and causing reciprocation of the piston.

* * * * *